US008029162B2

(12) United States Patent
Curran et al.

(10) Patent No.: US 8,029,162 B2
(45) Date of Patent: Oct. 4, 2011

(54) EMBEDDED LED LIGHT SOURCE

(75) Inventors: John W. Curran, Lebanon, NJ (US); John Patrick Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 73 days.

(21) Appl. No.: 11/744,072

(22) Filed: May 3, 2007

(65) Prior Publication Data

US 2007/0258244 A1 Nov. 8, 2007

Related U.S. Application Data

(60) Provisional application No. 60/797,430, filed on May 3, 2006.

(51) Int. Cl.
*F21V 29/00* (2006.01)

(52) U.S. Cl. ..... 362/294; 362/373

(58) Field of Classification Search ..... 362/294, 362/373

See application file for complete search history.

(56) References Cited

U.S. PATENT DOCUMENTS

| | | | | |
|---|---|---|---|---|
| 4,729,076 | A | 3/1988 | Masami et al. | |
| 5,821,695 | A | 10/1998 | Vilanilam et al. | |
| 6,045,240 | A * | 4/2000 | Hochstein | 362/294 |
| 6,354,714 | B1 | 3/2002 | Rhodes | |
| 7,374,315 | B2 * | 5/2008 | Dorsey et al. | 362/294 |
| 2005/0018435 | A1 * | 1/2005 | Selkee et al. | 362/427 |
| 2005/0213328 | A1 * | 9/2005 | Matheson | 362/267 |
| 2005/0243576 | A1 * | 11/2005 | Park et al. | 362/612 |
| 2005/0259424 | A1 * | 11/2005 | Zampini et al. | 362/294 |
| 2006/0077651 | A1 * | 4/2006 | Yamazaki et al. | 362/84 |
| 2006/0098441 | A1 * | 5/2006 | Chou | 362/294 |
| 2006/0133090 | A1 * | 6/2006 | Noh et al. | 362/294 |
| 2006/0187652 | A1 * | 8/2006 | Doyle | 362/96 |
| 2007/0064420 | A1 * | 3/2007 | Ng et al. | 362/231 |
| 2007/0103902 | A1 * | 5/2007 | Hsiao | 362/240 |
| 2007/0183156 | A1 * | 8/2007 | Shan | 362/277 |

FOREIGN PATENT DOCUMENTS

| | | |
|---|---|---|
| EP | 0 658 655 A1 | 6/1995 |
| WO | WO 2007-013121 | 2/2007 |

OTHER PUBLICATIONS

PCT International Search Report and Written Opinion for PCT/US07/68166, 9 pages.

* cited by examiner

*Primary Examiner* — Evan Dzierzynski

(57) ABSTRACT

A light source is disclosed. For example, the light source includes an enclosure forming an internal volume, the enclosure having at least one side, a top and a bottom. At least one light emitting diode (LED) may be deployed within the internal volume of the enclosure. Optionally, an optic may be coupled to each one of the at least one LEDs. The light source also includes a potting compound surrounding said at least one LED and substantially filling said internal volume or covering said top of said enclosure and substantially sealing said enclosure.

17 Claims, 7 Drawing Sheets

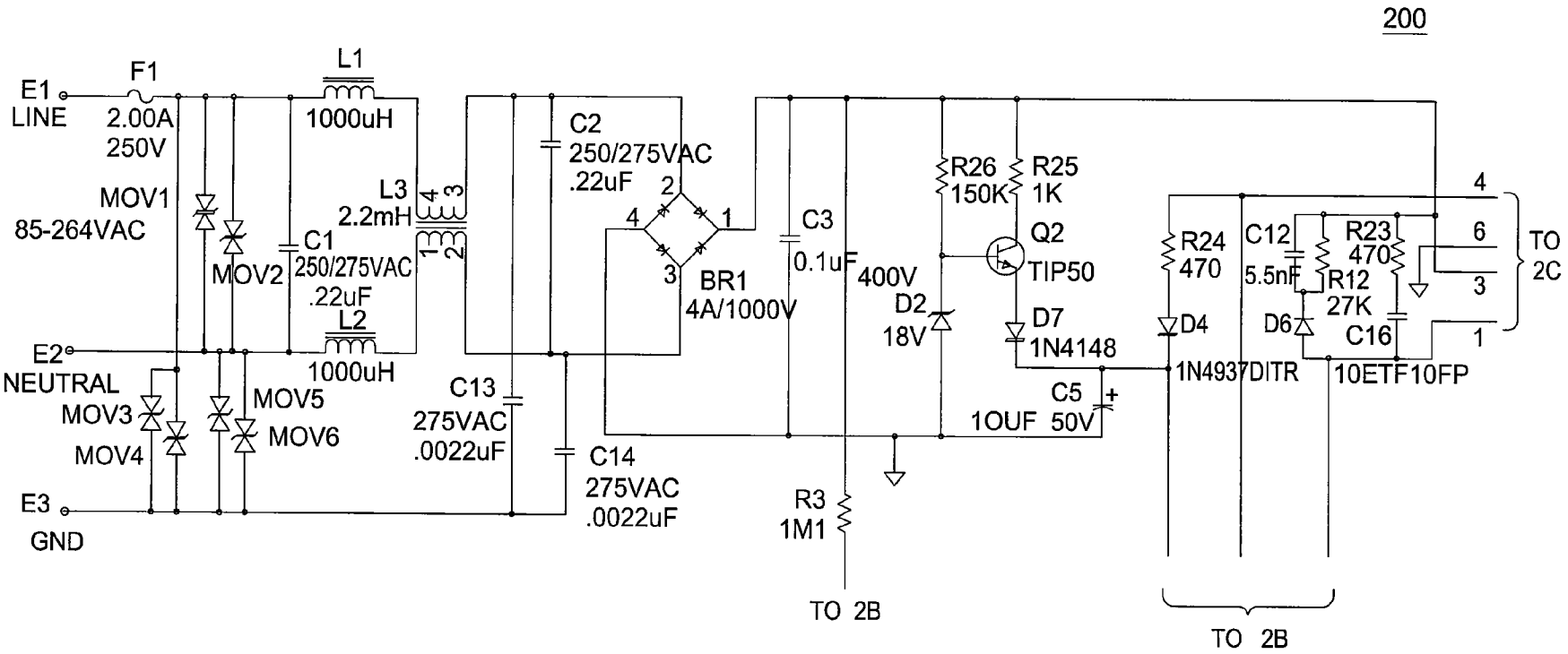
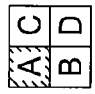
FIG. 2
FIG. 2A

EMBEDDED LED LIGHT SOURCE

CROSS REFERENCE TO RELATED APPLICATIONS

This application claims the benefit of U.S. Provisional Patent Application No. 60/797,430 filed on May 3, 2006, which is herein incorporated by reference.

FIELD OF THE INVENTION

The present invention relates generally to a light source, and more particularly to an LED light source.

BACKGROUND OF THE INVENTION

There are many industrial environments where explosive atmospheres are present due to the nature of the products produced or processed. Facilities such as oil refineries, gas processing plants, grain elevators, etc. are some examples of such environments where electrical discharges must be tightly controlled in order to prevent explosions.

Over the years standards have been developed to minimize the potential for electrical discharges such as sparks or arcs in electrical products placed in environments where explosive atmospheres are present. For example Class 1 hazardous environments include those containing flammable gases, vapors or liquids; Class 2 includes combustible dusts; Class 3 includes ignitable fibers. Environments where those explosive atmospheres are sometimes present are further classified as Division 2 environments. Therefore, an environment where flammable gases were sometimes present would be considered a Class 1, Division 2 area.

As with any type of environment, lighting is an important element. Lighting fixtures in locations where explosive atmospheres could be present require lighting fixtures which are resistant to exposing electrical discharges. In other words, the lighting fixtures used for Class 1, Division 2 areas should be fabricated such that they are safe for installation in Class 1, Division 2 areas.

SUMMARY OF THE INVENTION

In one embodiment, the present invention provides a light source. The light source comprises an enclosure forming an internal volume, said enclosure having at least one side, a top and a bottom. At least one light emitting diode (LED) may be deployed within said internal volume of said enclosure. The light source also includes a potting compound surrounding said at least one LED and substantially filling said internal volume.

In another embodiment, the present invention provides a light source comprising an enclosure forming an internal volume, said enclosure having at least one side, a top and a bottom. At least one light emitting diode (LED) may be deployed within said internal volume of said enclosure. The light source also includes a potting compound covering said top of said enclosure and substantially sealing said enclosure.

In another embodiment, the present invention provides a light source comprising an enclosure forming an internal volume, said enclosure having at least one side, a top and a bottom. At least one light emitting diode (LED) may be deployed within said internal volume of said enclosure. An optic may be coupled to each one of said at least one LED. The light source also includes a potting compound surrounding said at least one LED and substantially filling said internal volume.

BRIEF DESCRIPTION OF THE DRAWINGS

The teaching of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
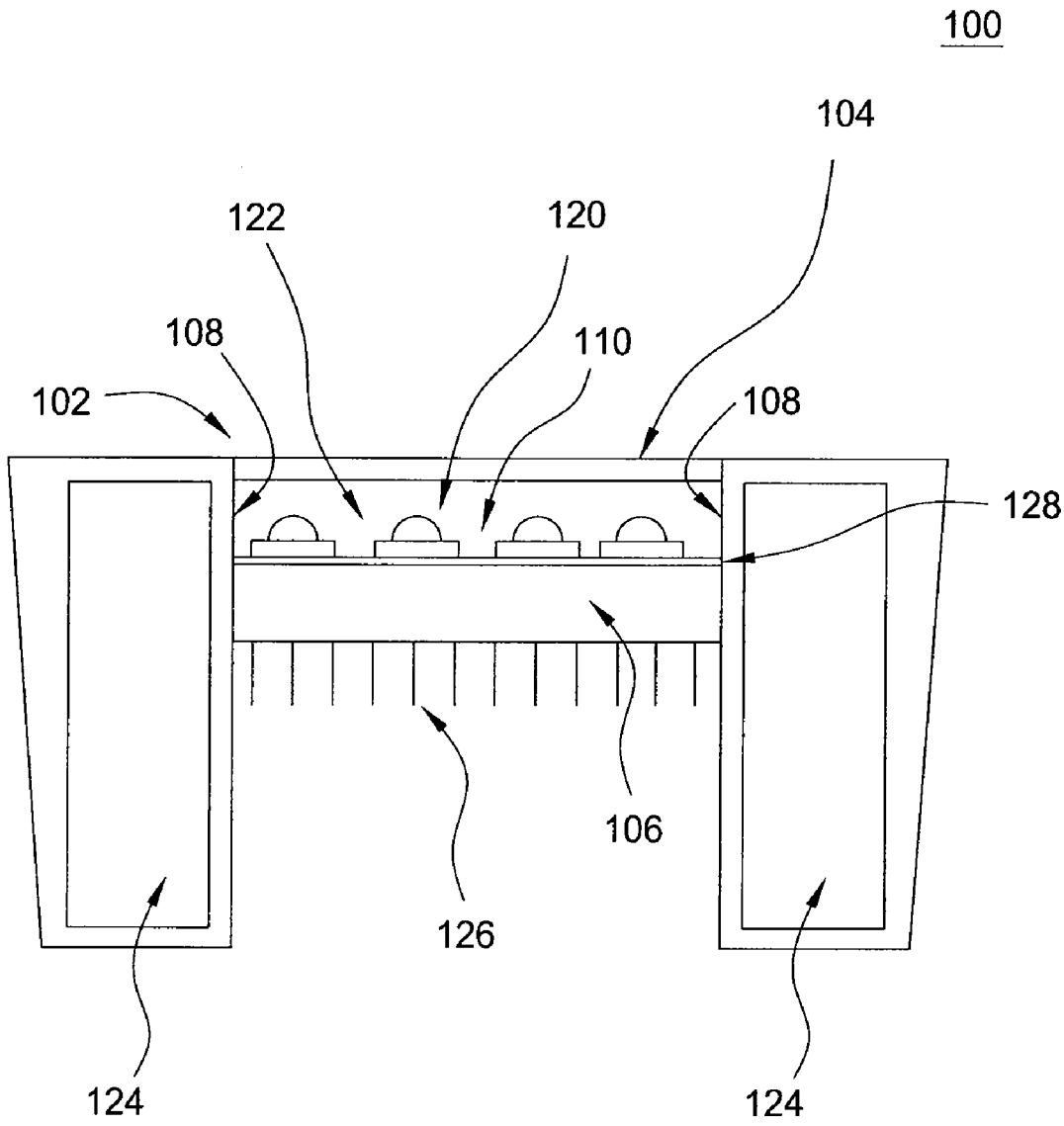
FIG. 1 depicts one embodiment of an embedded LED light source according to the present invention.

The present invention provides a unique enclosure for a light source, e.g. as used in Class 1, Division 2 areas. In one embodiment of the present invention a light emitting diode (LED) light source is embedded in an optically clear potting compound. By embedding the LED light source in an optically clear potting compound, the LED light source is surrounded and the potting compound completely or substantially fills any voids of an enclosure housing the LED light source. By eliminating all or most of the volume where explosive atmospheres could collect, this approach minimizes the potential that a spark in the LED light source could come in contact with a flammable atmosphere. The optically clear potting compound, while allowing light to leave the device, provides a barrier to vapor, dust and other explosive atmospheres. Since the LEDs and power supply can be potted and sealed, there is no need for heavy metal and glass casings. FIG. 1 depicts one embodiment of the LED light source 100.

In an exemplary embodiment, the LED light source 100 comprises an enclosure 102. Enclosure 102 is formed by a top 104, a bottom 106 and at least one side 108. The nomenclature of the top 104, a bottom 106 and at least one side 108 is relative to where LEDs 120 (used hereinafter to interchangeably mean either a single LED or more than one LED) are deployed within enclosure 120. For example, the portion of the enclosure 102 that the LEDs 120 are mounted on may be referred to as the bottom 106. In an exemplary embodiment, the bottom 106 may be fabricated from a thermally conductive material to help dissipate heat.

Referring back to the enclosure 102, enclosure 102 typically has as a number of sides 108 in proportion to a perimeter shape of enclosure 102. For example, if enclosure 102 has a perimeter shape of a square, enclosure 102 would have four sides 108. However, it is also possible that side 108 is a continuous cylindrical surface.

In an exemplary embodiment, the enclosure 102 is fabricated from extruded aluminum with end caps. Consequently, the enclosure 102 can be increased in length by two times or more. This could allow any number of arrays of LEDs 120 and power supplies 124 to provide illumination for very large applications.

In an exemplary embodiment, the top 104 is a plate made from an optically clear material, for example glass or plastic. The glass or plastic top 104 provides a surface which is more resistant to some corrosive atmospheres as well as providing a surface which can be more readily cleaned without the danger of scratching or wearing the surface. In addition, using an optically clear top 104 allows the light emitted from LEDs 120 to shine through. Although in the present embodiment, only the top 104 is made with an optically clear material such as glass or plastic, one skilled in the art will recognize, that any one of the sides 108 or bottom 106 may also be made with an optically clear material such as glass or plastic, depending on the desired direction of the light emitted from the LEDs 120.

Enclosure 102 creates a volume 110. At least one LEDs 120 may be coupled to an LED board 128 and placed within volume 110. LED board 128 may be fabricated from a thermally conductive material such as for example, a metal core circuit board. Similar to the bottom 106, as discussed above, fabricating the LED board 128 from a thermally conductive material helps to dissipate heat away from enclosure 102 during operation of LEDs 120.

In an exemplary embodiment, LEDs 120 may be coupled to a LED board 128 that is then coupled to the bottom 106 of enclosure 102. However, one skilled in the art will recognize that LEDs 120 may be placed anywhere in the volume 110 of enclosure 102. The number of LEDs 120 could be adjusted based on the desired amount of light required or as required by a particular application. Moreover, multiple rows of LEDs 120 in an array may be placed in the volume 110 of enclosure 102. Although only four rows of LEDs 120 in array are shown, the invention anticipates one or more rows of LEDs 120. In addition, different colored LEDs 120 may be used to achieve a desired color output and is not limited to a single colored LED 120. The enclosure 102 may be fabricated in any shape and size to accommodate the desired number of LEDs 120. This provides great flexibility to the manufacturing of the present LED light source 100.

The remaining volume 110 of enclosure 102 not filled by the LEDs 120 is substantially filled by a potting compound 122. The potting compound 122 may be an optically clear potting compound. The potting compound 122 may be made from silicone, acrylic, epoxy or urethane based materials, for example, silicone elastomers or polyurethanes. The potting compound 122 should be optically clear such that sufficient light may be emitted through the potting compound 122 and the top 104. Two exemplary silicone elastomers known under the trade names of SYLGARD® 182 and SYLGARD® 184, manufactured by DOW CORNING CORP. of Midland, Mich. may be used as the potting compound 122.

Figure 4:
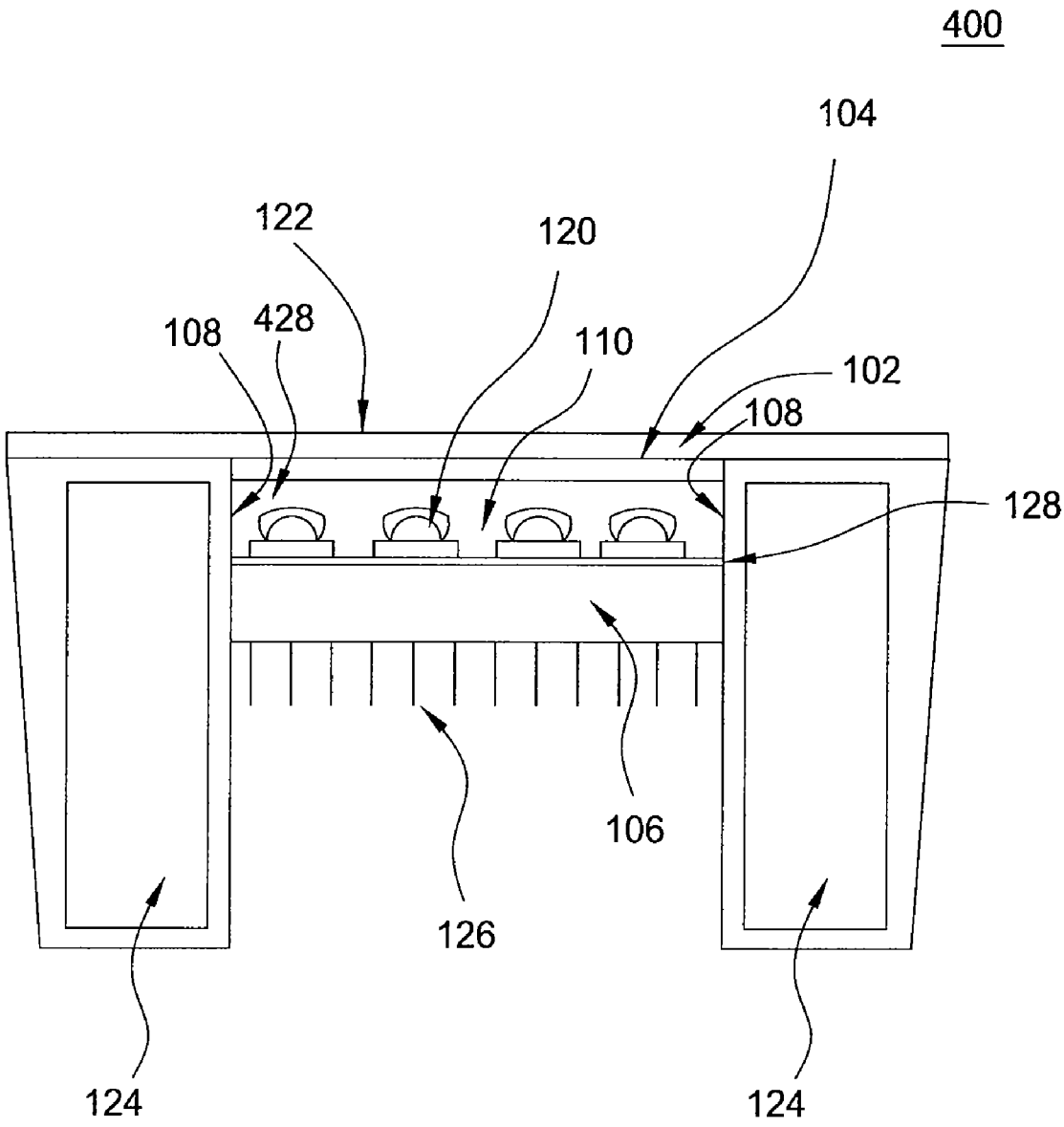
FIG. 4 depicts an alternate embodiment of an embedded LED light source having lenses according to the present invention.

Alternatively, for lighting applications that require an air-LED interface, the potting compound 122 may be used over an exterior side of the top 104 of enclosure 102. This would be useful if a lens 428, as illustrated in FIG. 4, were used in front of the LEDs and an air-LED interface was necessary. The potting compound 122 would still seal the enclosure 102, but putting the potting compound 122 on an exterior side of the top 104 would allow an air-LED interface. In yet another alternative, the potting compound 122 may be used over an exterior side of the top 104 of enclosure 102 to provide an additional seal in addition to filling the volume 110 of enclosure 102 with the potting compound 122.

The LED light source 100 also comprises at least one power supply 124 coupled to the enclosure 102 to power the LEDs 120. The power supply 124 may also be sealed using the potting compound 122. The power supply 124 may also form one of the at least one sides 108, discussed above, when coupled to enclosure 102.

Figures 2, 2B:
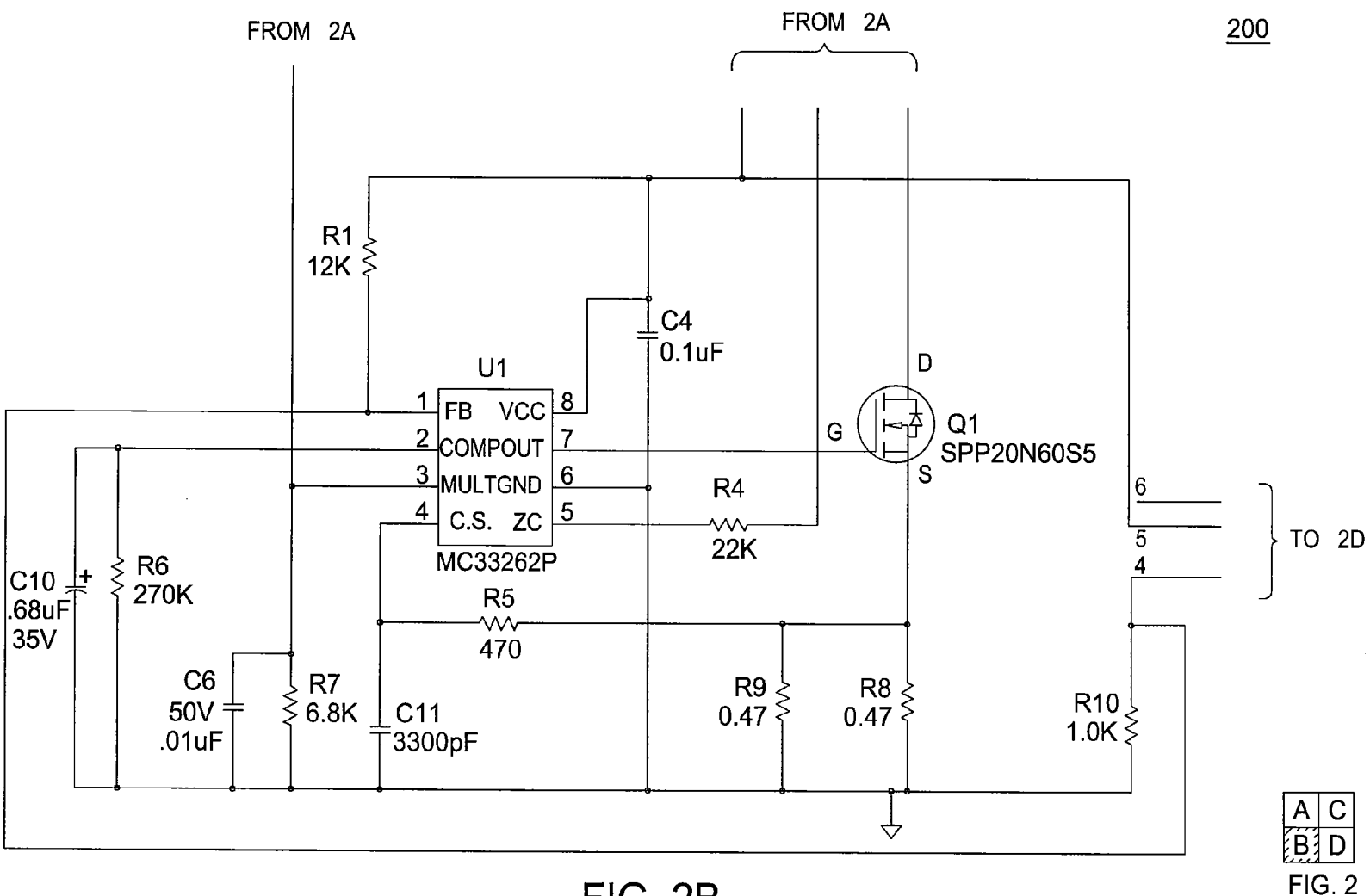
FIG. 2 depicts a circuit schematic of one embodiment of a power supply according to the present invention.
Figure 2C:
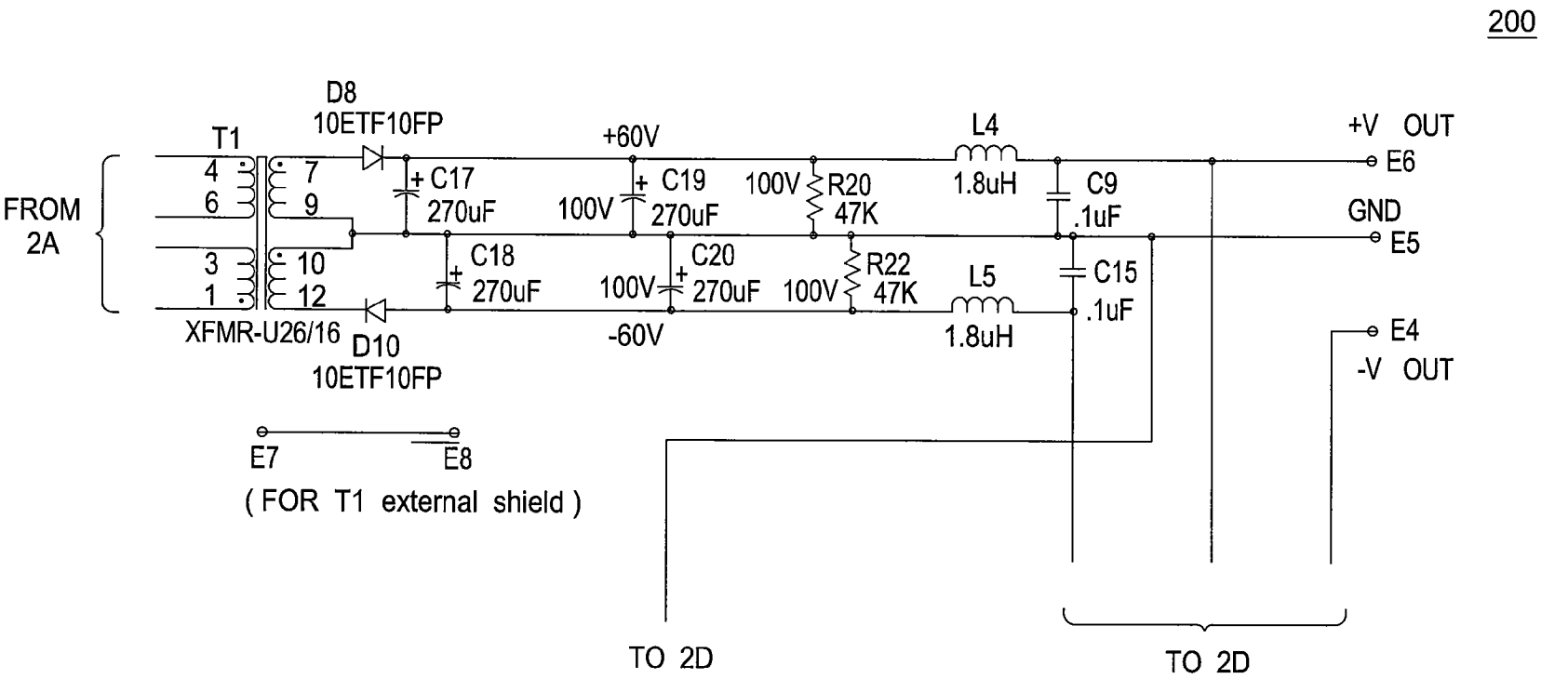
Figure 2:
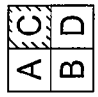
Figure 2D:
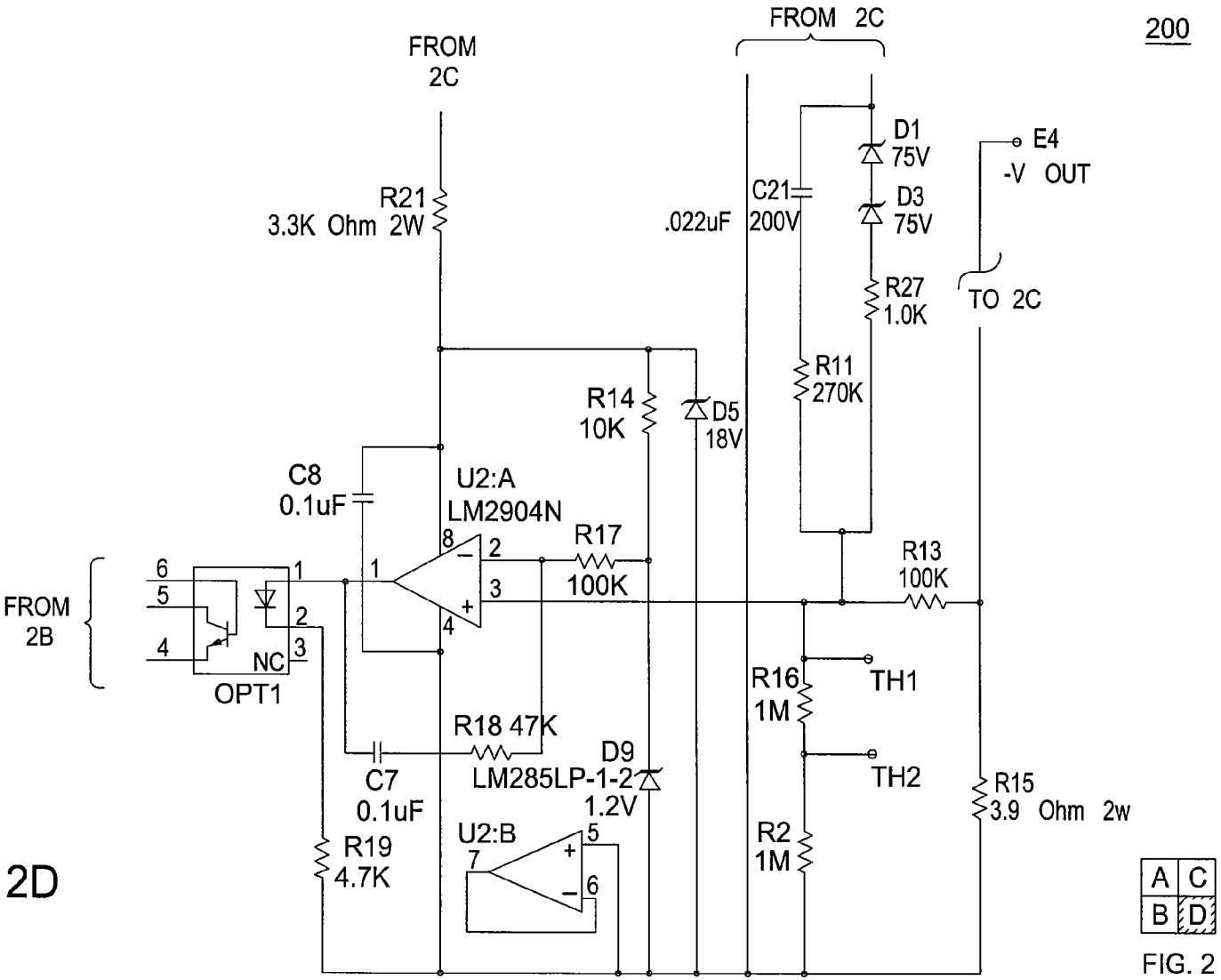

The power supply 124 used to drive the LEDs 120 is also required to meet certain specifications designed to minimize the potential for electrical discharge. Since the LEDs 120 typically requires a constant current source, the power supply 124 must be able to provide this current while at the same time meeting the electrical requirements for a hazardous location classification (e.g., Class 1 Division 2 power supply). FIG. 2 depicts a circuit schematic 200 of one embodiment of the power supply 124 which can provide the required constant current for the LED light source 100 used in a hazardous environment. In addition, the power supply 124 also meets the power supply requirements for hazardous environments, such as for example, a Class 1, Division 2 classification.

Furthermore, when LED light source 100 uses an embodiment containing multiple rows of LEDs 120 in an array, as discussed above, LED light source 100 may include an equivalent number of power supplies 124 to power each respective row of LED arrays. This provides added redundancy to the LED light source 100, thereby, increasing the longevity and utilization rate (i.e., minimizing downtime for maintenance or replacement) of the LED light source 100.

The LED light source 100 may also include heat sink fins 126 to help remove heat from LEDs 120 when in operation. The heat sink fins 126 may be fabricated from thermally conductive materials, e.g., aluminum, to help dissipate heat any heat generated from the operation of LEDs 120. Consequently, heat sink fins 126 help prevent LEDs 120 from failing due to over heating. In addition, heat sink fins 126 may help prevent ignition of any flammable gases, vapors or liquids that may be found in hazardous environments from the heat generated from operating LEDs 120. The shape, size and number of heat sink fins 126 used may be determined by the number of LEDs 120 used in the LED light source 100. In an exemplary embodiment, the heat sink fins 126 may be coupled anywhere to the enclosure 102 on an opposing side of the LEDs 120. For example, the heat sink fins 126 are directly coupled to the same bottom 106 that the LEDs 120 are mounted on. In other words, if LEDs 120 are coupled to an interior side of bottom 106 of enclosure 102, the heat sink fins 126 would be coupled on an opposing exterior side of the bottom 106.

In alternate embodiments of the present invention, optics may be coupled to one or more of the LEDs 120. The optics may be used to produce different lighting patterns based on desired lighting requirements. One skilled in art will recognize how to couple the optics to the LEDs 120 based upon the type of optic being used and the type of LED 120 being used.

Figure 3:
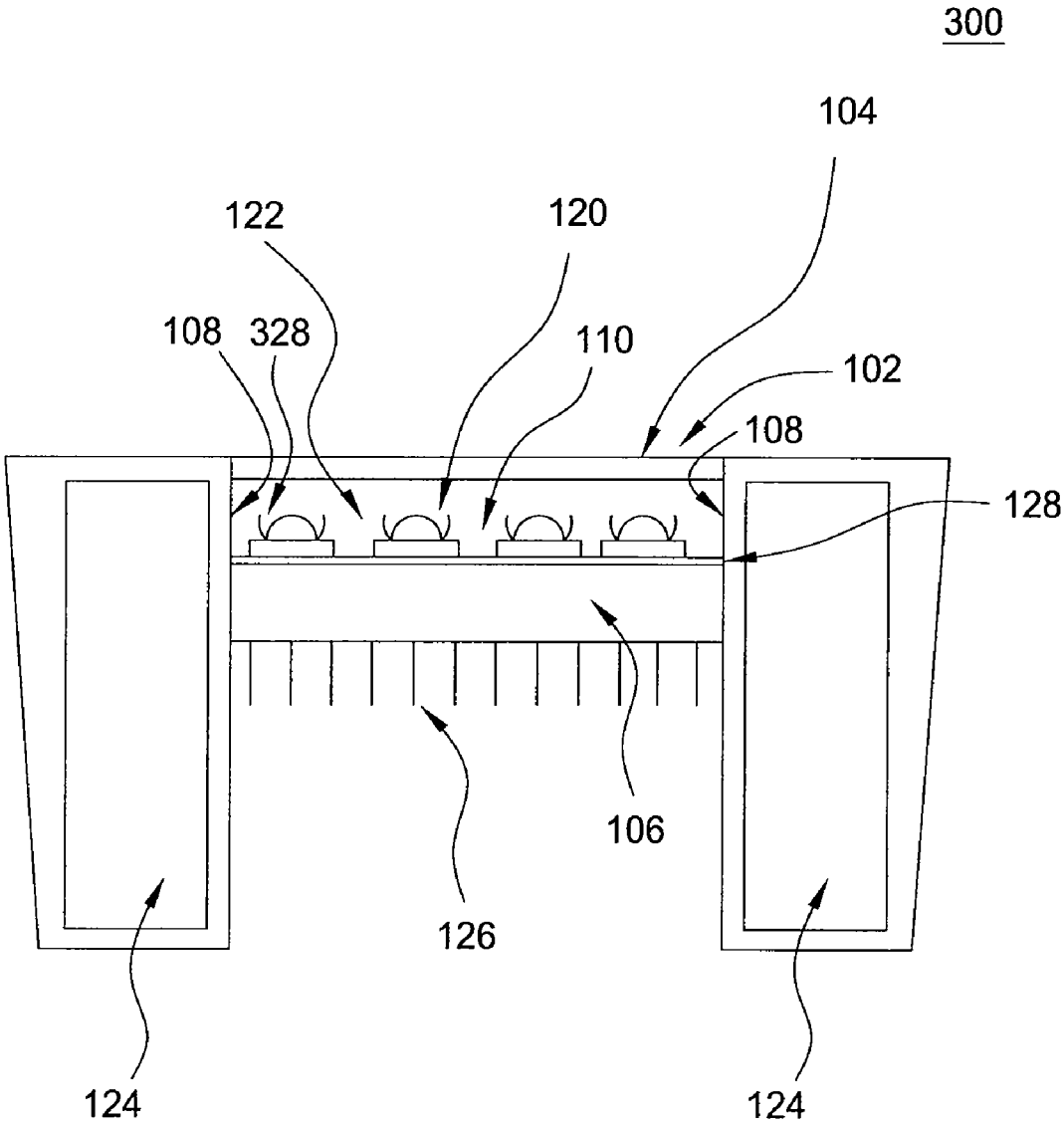
FIG. 3 depicts an alternate embodiment of an embedded LED light source having reflectors according to the present invention.

For example, as illustrated in FIG. 3, the optics may be reflectors 328. FIG. 3 illustrates an exemplary LED light source 300 using reflectors 328. The shape and size of the reflectors 328 may be varied to produce light in different patterns based on the desired lighting requirements. The number of reflectors 328 used may also vary based on the desired lighting requirements. The reflectors 328 may be fabricated from molded plastic or polished metal. If molded plastic is used to manufacture the reflectors, the molded plastic may be metalized with a reflective material, such as for example, aluminum. The LED light source 300 may be similar to LED light source 100 in all other respects as illustrated by FIG. 3.

In yet another embodiment, the optics may be lenses 428. FIG. 4 illustrates an exemplary LED light source 400 using lenses 428. Similar to reflectors 328, various shapes of lenses 428 may be used to produce light in different patterns based on the desired lighting requirements. The number of lenses 428 used may also vary based on the desired lighting requirements. The lenses 428 may be fabricated from glass or plastic.

When using lenses 428, the LEDs 120 may require an air-LED interface as discussed above. Therefore, the LED light source 400 using lenses 428 may use the potting compound 122 over an exterior side of the top 104 of enclosure 102. The potting compound 122 would still seal the enclosure 102, while allowing an air-LED interface. Consequently, the potting compound 122 would prevent any flammable gases, vapors or liquids that may be found in hazardous environments from entering the enclosure 102 and being ignited by any sparks or arcs that may be created by the operation of LEDs 120.

The embodiments of LED light sources 100, 300 and 400 disclosed above, allows for a lighter unit since the heavy metal barrier and thick glass cover of traditional hazardous location lights are eliminated. Using this approach also allows greater flexibility in lighting fixture design. The use of LEDs 120 in the unit provides advantages including: relatively small size of source; long lifetime and low operating voltage. Although the LED light sources 100, 300 and 400 are discussed as being mounted in facilities where hazardous environments may be present, one skilled in the art will recognize that LED light sources 100, 300 and 400 may have application in other environments.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light source, comprising:

an enclosure forming an internal volume, said enclosure having at least one side, a top and a bottom;

at least one light emitting diode (LED) deployed within said internal volume of said enclosure;

a potting compound surrounding said at least one LED and substantially filling said internal volume, wherein the potting compound provides a barrier between the at least one LED and a flammable atmosphere;

a plurality of heat sink fins coupled to an exterior side of said enclosure opposing said at least one LED and in direct contact with an atmosphere external to said enclosure; and at least one power supply coupled to said enclosure to power said at least one LED with a constant current, wherein said at least one power supply forms a side of the enclosure and is sealed with said potting compound.

2. The light source of claim 1, wherein said top comprises a clear plate.

3. The light source of claim 2, wherein said clear protective plate is fabricated from glass or plastic.

4. The light source of claim 1, wherein said potting compound is clear.

5. The light source of claim 4, wherein said potting compound comprises at least one of a silicone, acrylic, epoxy or urethane based material.

6. The light source of claim 5, wherein said silicone elastomer comprises at least one of Sylgard 182 or Sylgard 184.

7. The light source of claim 1, wherein said at least one LED comprises at least one array of LEDs and said at least one power supply comprises a plurality of power supplies wherein at least one power supply is used to power each of said at least one array of LEDs.

8. The light source of claim 1, wherein said enclosure is fabricated from aluminum.

9. A light source, comprising:

an enclosure forming an internal volume, said enclosure having at least one side, a top and a bottom;

at least one light emitting diode (LED) deployed within said internal volume of said enclosure;

a potting compound covering an exterior side of said top of said enclosure and substantially sealing said enclosure, wherein said internal volume of said enclosure is substantially free of said potting compound to create an air-LED interface, wherein the potting compound provides a barrier between the at least one LED and a flammable atmosphere;

a plurality of heat sink fins coupled to said enclosure opposing said at least one LED and in direct contact with an atmosphere external to said enclosure; and at least one power supply coupled to said enclosure to power said at least one LED with a constant current, wherein said at least one power supply forms a side of the enclosure and is sealed with said potting compound.

10. The light source of claim 9, wherein said internal volume is substantially filled with air.

11. The light source of claim 9, wherein said top comprises a clear plate fabricated from glass or plastic.

12. The light source of claim 9, wherein said potting compound comprises at least one of a silicone, acrylic, epoxy or urethane based material.

13. A light source, comprising:

an enclosure forming an internal volume, said enclosure having at least one side, a top and a bottom;

at least one light emitting diode (LED) deployed within said internal volume of said enclosure;

an optic coupled to each one of said at least one LED;

a potting compound surrounding said at least one LED and said optic coupled to said at least one LED and substantially filling said internal volume, wherein the potting compound provides a barrier between the at least one LED and a flammable atmosphere;

a plurality of heat sink fins coupled to said enclosure opposing said at least one LED and in direct contact with an atmosphere external to said enclosure; and at least one power supply coupled to said enclosure to power said at least one LED with a constant current, wherein said at least one power supply forms a side of the enclosure and is sealed with said potting compound.

14. The light source of claim 13, wherein said optic comprises a reflector.

15. The light source of claim 13, wherein said optic comprises a lens.

16. The light source of claim 13, wherein said top comprises a clear plate fabricated from glass or plastic.

17. The light source of claim 13, wherein said potting compound comprises at least one of a silicone, acrylic, epoxy or urethane based material.

* * * * *